428-911
1/13/81 XR 4,244,570 SR

United States Patent [19] [11] 4,244,570
Murrey, Sr. [45] Jan. 13, 1981

[54] METHOD FOR RESURFACING BOWLING ALLEYS

[76] Inventor: Gordon W. Murrey, Sr., 14150 S. Figueroa, Los Angeles, Calif. 90061

[21] Appl. No.: 919,075

[22] Filed: Jun. 26, 1978

[51] Int. Cl.[3] ..... A63D 1/04; B32B 35/00

[52] U.S. Cl. ..... 273/51; 52/408; 52/746; 156/71; 156/90; 156/92; 156/94; 156/98; 273/37; 428/63; 428/464; 428/528; 428/535; 428/911

[58] Field of Search ..... 52/408, 746; 156/71, 156/90, 92, 94, 98; 273/37, 51; 428/63, 464, 528, 535, 911

[56] References Cited

U.S. PATENT DOCUMENTS

| | | | |
|---|---|---|---|
| 2,202,674 | 5/1940 | Seaman et al. | 273/82 |
| 2,630,395 | 3/1953 | McCullough et al. | 428/63 X |
| 3,312,469 | 4/1967 | Clayton | 273/51 |
| 4,146,223 | 3/1979 | Stottman | 273/51 |

OTHER PUBLICATIONS

"Bowling", Jan., 1977, pp. 2, 3 and 6.

*Primary Examiner*—John T. Goolkasian
*Assistant Examiner*—Robert A. Dawson
*Attorney, Agent, or Firm*—Fulwider, Patton, Rieber, Lee and Utecht

[57] ABSTRACT

A method for resurfacing a bowling alley to fill dents and overlie the original wood surface with an oil barrier layer over which is adhesively affixed a high pressure laminate material layer with an external surface having the appearance of the original surface of the alley.

20 Claims, 11 Drawing Figures

METHOD FOR RESURFACING BOWLING ALLEYS

BACKGROUND OF THE INVENTION

1. 'Field of the Invention

The present invention generally relates to methods for resurfacing bowling alleys with an overlying material layer and, more particularly, to a method which includes an oil barrier layer between the original wood surface and the overlying resurfacing layer.

2. 'Description of the Prior Art

A conventional technique for resurfacing a bowling alley is to sand down the wooden surface to remove the finish and accmulated ball dents. The exposed wood surface is then refinished with a varnish or a polyurethane lacquer or similar material.

A newer resurfacing technique involves replacement of the original wooden surface with a commercially available high pressure laminate material with an external hard plastic surface which has the appearance of the original wood. The laminate material is adhesively fixed in place upon the sanded original wood surface. But, in many cases, the original oiled wood creates a capillary action which brings the oil into contact with the adhesive which deteriorates the adhesive and permits the laminate to separate from the wood surface. Additionally, ball impacts on the approach section due to dropped balls and pin impacts on the pin deck sections which occur when the ball strikes the pins loosens the adhesive bond.

Thus, there has been a need for a method for resurfacing a bowling alley with such high pressure laminate materials which would not result in loosening of the laminate due to the deterioration of the adhesive by oil seepage or ball and pin impacts. The present invention satisfies that need.

SUMMARY OF THE INVENTION

The present invention provides a method of resurfacing a bowling alley with a high pressure laminate material adhesively bonded to an oiled wood surface without adhesive deterioration by means of an intermediate barrier layer impervious to oil which is not only adhesively affixed to the surface of the wood, but preferably further fixed in place by mechanical means such as screws. The laminate may then be adhesively affixed in place on the barrier layer without the possibility of oil contacting the adhesive. In addition, while a first barrier layer in the lane section of the bowling alley is of some durable material, such as hardboard, the areas of the alley subject to numerous impacts, such as the approach section and the pin deck section, are provided with second barrier layers made of a relatively hard material, preferably metallic, to aid in resisting damage to the laminate material during the impacts.

The method is practiced by first determining the areas of dents in the alley, usually within the approach section and the pin deck section, and adhesively affixing therein small patches without regard to the fact that the patch may be above the surface level of the alley. The entire alley, including the patches, are then sanded to remove the finish on the alley and bring the patches from the dents to the same level. A first barrier layer, preferably made of hardboard, is then adhesively affixed in place on the lane section and preferably more positively fixed to that surface by mechanical fastening means such as screws. In the approach sections and pin deck sections of the alley, a second barrier layer is preferbly made of a harder material, such as metal or hard plastic, which is also preferably positively fixed in place with screws. A high pressure laminate layer having an external surface layer which has the appearance of the original wood surface is then adhesively fixed in place over the barriers with the adhesive completely isolated from any oil which may seep up through the wood. Should the oil cause deterioration of the adhesive between the wood and the barrier, the screws will still maintain the barriers in close contact with the wood.

Thus, the method of the present invention provides for patching the dents in the alley surface prior to sanding and then fixing in place an oil-impervious barrier layer made either of a relatively hard material such as hardboard or metal over the wood prior to adhesively bonding the high pressure laminate to the surface of the barrier.

These and other features of the invention will become apparent from the detailed description below.

DESCRIPTION OF THE PREFERRED EMBODIMENT

Figure 1:
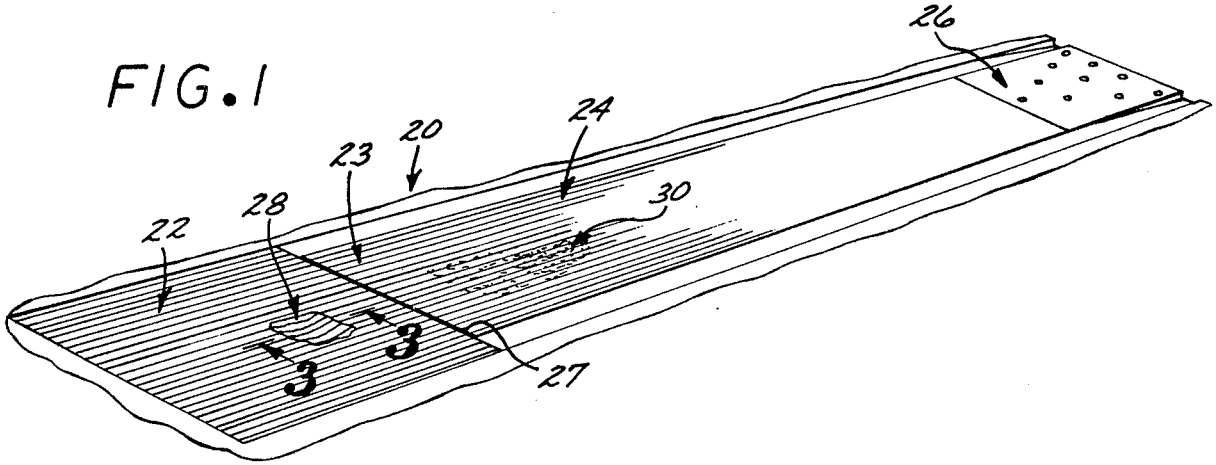
FIG. 1 is a perspective view of the surface of a bowling alley prior to the commencement of the refinishing method of the invention.
Figure 2:
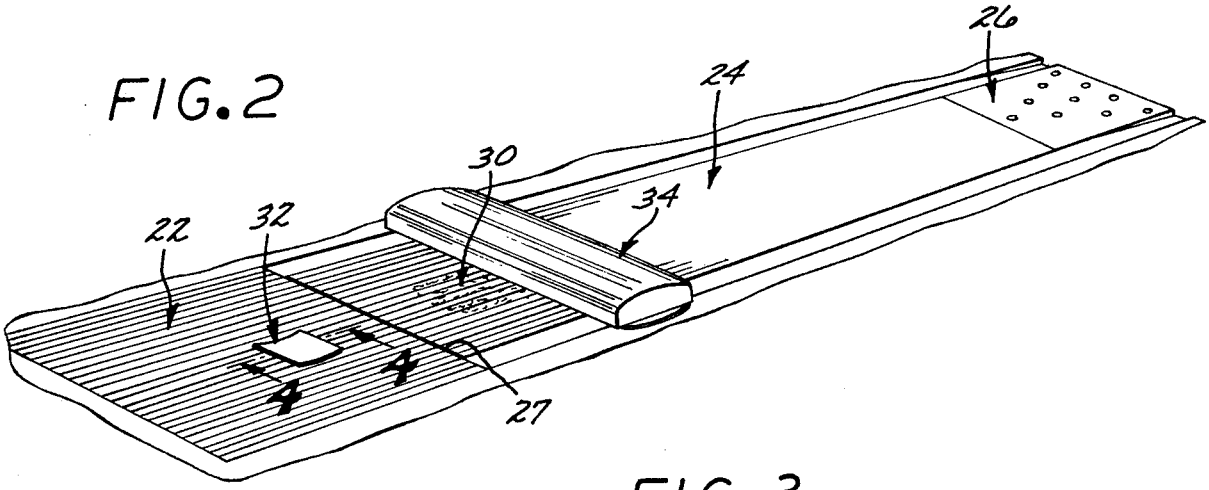
FIG. 2 is a perspective view of the same alley having been patched and in the process of being sanded.

Referring now to the drawings, and particularly FIG. 1 thereof, a bowling alley 20 is shown prior to utilization of the refinishing method of the present invention. Typically, such bowling alley includes a bed generally designated 16 (FIGS. 7 and 8) constructed of longitudinal bed stock, strips 17 joined together along their opposite transverse faces by relatively loose tongue and groove joints. The alley 20 is refinished by patching dents 28, sanding the patched surface, fixing a barrier layer 36, 43, 42 and 44 (FIG. 6) on the sanded surface and overlying all with a high pressure laminate cover 50.

Basically, the alley 20 is typically about 79 feet, 10-3/16 inches long, has an approach section 22 of at least 15 feet, a lane section 24 of 60 feet from the foul line 27 to the head pin, and a pin deck section 26 under the 2 feet, 10-3/16 inch deck length from the head pin to the end of the alley. A ball impact section 23 extends beyond the foul line 27 leading to the lane section 24 for receiving the ball is released by the bowler. Since the bowling ball merely rolls down the lane section 24 there are normally no significant impact forces between the ball and the lane so such lane may be constructed of a relatively soft wood such as pine. In the approach section 22, however, a bowling ball may be dropped from the bowler's hand onto the alley so the approach section is constructed of relatively hard wood such as maple. Further, in the pin deck section 26, the struck pins frequently rebound to impact the surface of the deck with great force, so it also is constructed of relatively hard wood such as maple.

Figure 3:
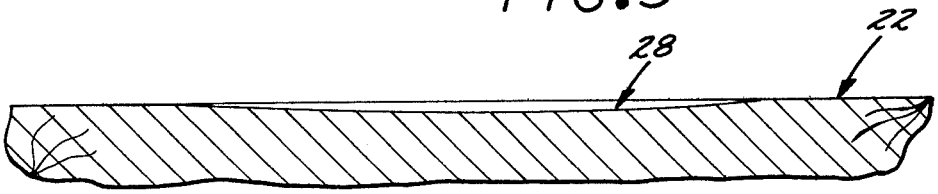
FIG. 3 is an enlarged cross sectional view taken in the direction of lines 3-3 of FIG. 1 illustrating a dent in the surface of the alley.
Figure 4:
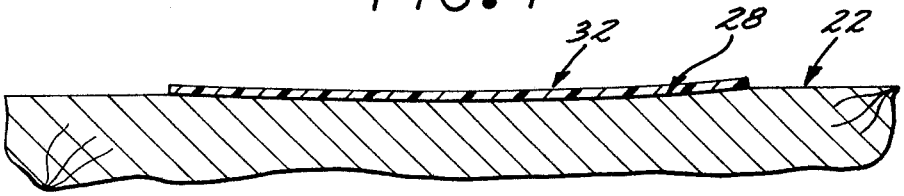
FIG. 4 is an enlarged cross sectional view in the direction of line 4—4 of FIG. 2 showing a patch in place.

The bowling alley 20 illustrated in FIG. 1 is shown as it would appear after prolonged use and includes a plurality of relatively large dents, such as the dent 28, for example, and a plurality of smaller dents and scratches illustrated by the area 30. The dent 28, illustrated in enlarged cross section in FIG. 3, when more than about ½ inch deep, is repaired by adhesively fixing in place a patch 32, preferably made of a very hard material such as a high pressure laminate. As can be seen in FIG. 4, the patch 32 extends above the surface of the approach section 22 as it fills the dent 28.

Figure 5:
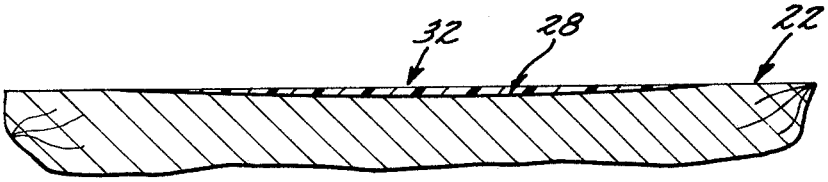
FIG. 5 is a cross sectional view showing the sanded patch.

When all of the patches 32 are in place, the entire alley 20 is sanded with an automatic sander 34 which produces an even surface with the finish removed. It also reduces the patch 32 to a level of the remainder of the approach section 22 as illustrated in FIG. 5. Additionally, in the sanding process the minor dents and scratches 30 are simply removed.

It will be appreciated that the method of the present invention may be practiced in many different ways. While it may be preferable that lamination of the barriers and cover layer take place at the factory, for clarity of explanation, the barrier and cover layer will first be described as being laminated at the site of installation.

Figure 9:
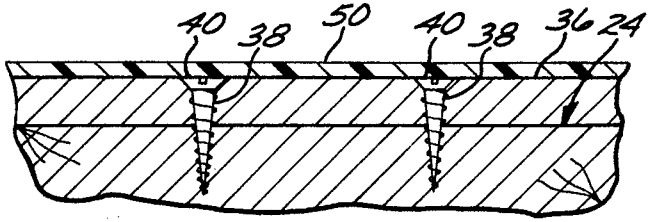
FIG. 9 is an enlarged cross sectional view of the alley taken in the direction of line 9—9 illustrating the mechanical fastening means for the barriers.

At such on-site installation, after the patching and sanding steps have been completed, an oil-impervious fiberboard spacer 36 (FIG. 6) is adhesively fixed in covering relationship over the lane section 24 to build such lane up about ⅜ inch for purposes that will be made apparent hereinafter. The lane spacer 36 may be made of any oil-impervious material such as hardboard to aid in oil resistance, and the adhesive is preferably a rubber-based contact cement. The lane spacer layer need only be thick enough to correspond with the thickness of approach and pin deck barrier plates 42 and 44 and to form a suitably hard support for the finishing layer. A thickness of ⅜ inch to 5/16 inch has been found adequate and in the preferred embodiment a thickness of ⅜ inch is selected. If desirable, such spacer layer 36 may be anchored to the lane section 24 by some mechanical means, such as screws 38, as illustrated in FIG. 9. It will be appreciated that the screws 38 may be employed for this purpose as the screw heads 40 will be later covered and not appear on the finished surface of the bowling alley 20.

Figure 6:
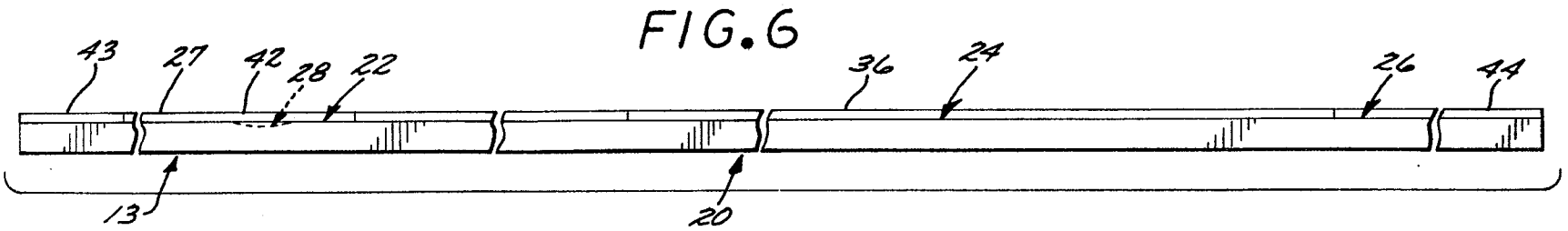
FIG. 6 is a side view of the alley with the barrier layers in place.
Figure 7:
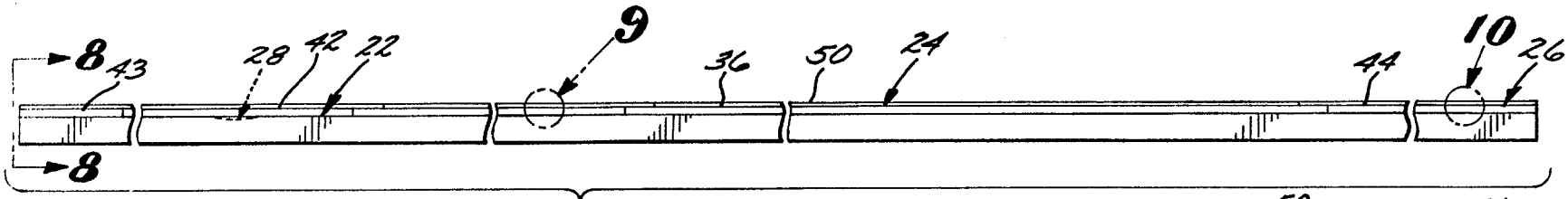
FIG. 7 is a side view of the alley showing the high pressure laminate layers in place.
Figure 10:
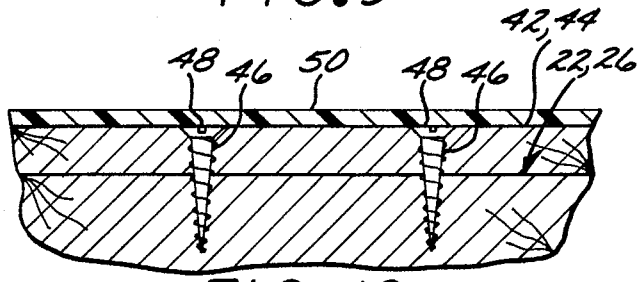
FIG. 10 is an enlarged sectional view taken in the direction of line 10—10 of FIG. 7 also illustrating the means of fastening the barrier to the wood surface.

In the approach section 22, ball impact section 23 and the pin deck section 26, barrier plates 42 and 44 are provided, and these barrier plates are constructed of a relatively rigid material such as steel, aluminum or hard plastic, which is oil-impervious and provides support for weight distribution and impact resistance. The barriers 42 and 44 are adhered to the bed 16 by adhesive and are mechanically anchored thereto by means of screws 38. The approach section 22 is typically a minimum of five feet long and the approach barrier plate preferably overlies the bed 16 from a point 4 feet aft of such foul line to a point, at least 8 feet, and preferably about 16 feet, in front of such foul line. The bed 16 is covered in back of the approach barrier 27 by means of a hardboard spacer 43 (FIG. 6). The pin deck barrier 44 is 5 feet in length to cover the entire length of the pin deck and both the approach barrier plate 42 and such pin deck plate 44 are mechanically anchored to the bed 24 by means of wood screws (FIG. 10).

Figure 8:
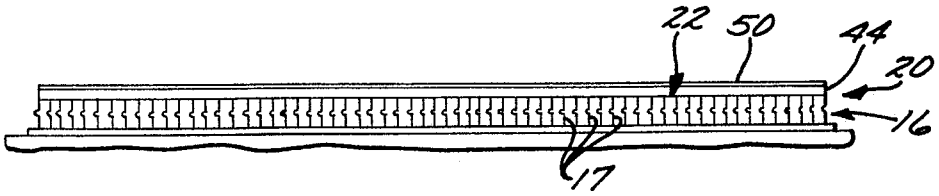
FIG. 8 is an end view of the alley illustrating the dovetailed bed stock.

Following the application of the oil-impervious approach and impact, pin deck barriers 42, 44, lane spacer barrier 36 and approach barrier spacer 43, the entire bowling alley 20 is covered with a high pressure laminate material layer 50 having an upper surface layer which has the appearance of the original wooden surface of the bowling alley 20. Such materials are commercially available and one example of which is G.E. PERMALANE, manufactured by the General Electric Company. Such material has a base of high pressure laminate with an integral external surface layer of hard plastic melamine which has a pattern substantially similar to the appearance of the elongated laminated bed stock of a bowling alley 20 which is created by the tongue-and-groove stacking of a plurality of elongated wooden strips such as illustrated in FIG. 8. This cover material is available in thicknesses varying from approximately ⅛ inch to 3/16 inch.

The laminate material cover 50 is fixed in place on the surface of the barriers 36, 42, 43 and 44 by means such as adhesive, preferably a rubber-base contact cement. Since barriers 36, 42, 43 and 44 effectively prevent any oil from reaching the adhesive fixign the laminate layer 50 to the barrier layers 36, 42 and 44, there is no deterioration of the adhesive due to oil contamination and the laminate layer 50 will remain in place on the barrier layers 36, 42, 43 and 44 even in the high-impact areas such as the approach section 22 and pin deck section 26.

In operation, when the bowler approaches the foul line 23, the force of high weight as applied to the cover 50 is resisted by the approach barrier-spacer 43 and distributed over a number of adjacent deck slats 17 (FIG. 8) and as such bowler lowers to his ball release stance, the force of his sliding feed is resisted by the aluminum approach barrier 42 supporting the cover layer 50, thus distributing such force over a number of adjacent slats 17 to minimize relative movement therebetween and blocking flow of any oils that may have been absorbed by such slots over the years' repeated dressings thereof. It has been determined that impacting and working of the slats 17 relative to one another causes release of such oils and rising to the surface thereof by capillary action. It is important that egress of such oils from the joints between such slats and to the adhesive bonding the thin cover 50 be blocked to prevent release thereof after repeated flexing of adjacent slats 17 relative to one another.

As the bowling ball is released and impacts the lane ahead of the foul line 27, it will make point contact with the cover 50 resulting in great force being applied over a small area. However, the aluminum barrier 44 acts to offer resistance to such force, resists deformation and the relative rigidity thereof distributes the point force over a greater area, as for instance over 3–6 adjacent slats 17, thus minimizing relative movement therebetween and consequent further loosening of the nails holding such slats together and blocking upward seepage of oil to the bond interface between such barrier and the finishing cover 50.

The released bowling ball will then take its course down the lane over the layer 50 covering the fiber board 36 in the direction of the head pin standing on the pin deck 26. As such ball strikes the bowling pins they will many times fly against the side and end walls of the alley, to rebound to the pin deck with great force making point contact with the deck surface. In a manner similar to that described above with respect to ball impact, the pin deck barrier 44 (FIG. 7) will act to resist such point and consequent denting and will distribute such force over a number of adjacent slats 17 while acting as a barrier to uprising oils or compounds released by such slots as a result of impact and consequent flexture thereof.

Figure 11:
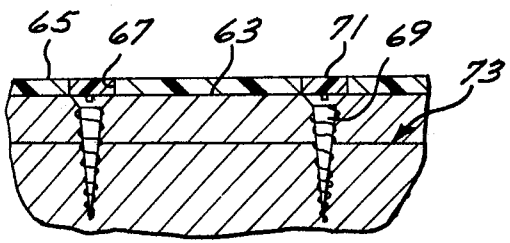
FIG. 11 is a sectional view of an alternate embodiment of the bowling alley construction of the present invention.

As mentioned hereinabove, in practice the barrier and cover layer are frequently bonded together at the factory prior to shipment to the construction site. Referring to FIG. 11, in that instance, the aluminum barrier plate 63 has the high pressure laminant layer 65 bonded thereto at the factory. It will be appreciated that the cover layer 65 may, if desired, be of any desired upwardly facing surface but, in the preferred embodiment, actually simulates a conventional bowling alley surface. Bores 67 may be pre-drilled through the laminant 65 for countersinking of fasting screws 69 and bores predrilled through the barrier 63. At the construction site, the laminated barrier plate 63 and cover 65 are placed on the bed stock 73, adhered thereto, and bores drilled for such screws. The screws 69 are then inserted to anchor the barriers in place and the plugs 71 inserted to aesthetically cover the heads of such screws.

Thus, the laminated bowling alley construction of the present invention provides a surface exhibiting characteristics simulating both the appearance and performance of conventional tongue and groove bowling alleys, while providing for long wear and resisting deterioration due to impact of balls and pins thereon, as well as resisting wear from ball skid and bowler shoe sole skid. Even more importantly, when the high pressure covering laminant simulating bowling alley surface does eventually become worn or deteriorated, it may be relatively economically and conveniently removed and replaced with new covering laminant without the bowling alley owner incurring the prohibitively high cost attendant coventional resurfacing involving sanding of the scarred or worn alley and refinishing and dressing thereof. It will be apparent that the covering laminant may be replaced numerous times at relatively little expense, thus extending the service life of the bowling alley itself and sharply reducing the maintenance and repair costs associated therewith.

While a presently preferred embodiment of the method of the invention has been described in detail above, it will be appreciated that various other materials and additional steps may be employed. Therefore, the invention is not to be limited, except by the following claims.

I claim:

1. A method for resurfacing tongue and groove bowling alleys constructed of side by side slats to form a wooden alley bed defining an approach section leading to a foul line, ball impact section forward of said foul line, an intermediate lane section, and forward pin deck section for supporting bowling pins, said method comprising the steps of:

removing the existing finish and refacing the wooden alley bed to create a substantially even base surface;

overlying at least a portion of said approach section and pin deck section base surface with respective approach and pin deck barrier plates of a uniform thickness and having upwardly facing top surfaces, said barrier plates being characterized in that the said upwardly facing top surfaces are harder than the top surface of said base surface of said bed and said plates are of a sufficient predetermined thickness to be more resistent to deformation by downwardly acting forces applied thereto than said base surface;

affixing said barrier plates to said base surfaces;

overlying the lane section base surface intermediate said approach and pin deck sections with a lane spacer of said uniform predetermined thickness;

affixing said spacer to said base surface;

overlying said barrier plates and lane spacer with a preformed finishing layer having greater flexibility than said barrier plates; and, affixing said finishing layer to said preformed barrier plates and said lane spacer whereby downwardly acting forces applied to said finishing layer against said barrier plates will support said finishing layer over said barrier plates to thus support said finishing layer against local downward flexing which could cause stress build up in the interface between said barrier plate and finishing layer.

2. A method as set forth in claim 1 wherein:

said step of overlying said base with barrier plates includes overlying said ball impact section with a portion of one of said barrier plates.

3. A method as set forth in claim 1 wherein:

said step of affixing said barrier plates includes fastening said plates to said base with mechanical fasteners.

4. A method as set forth in claim 1 wherein:

said step overlying said barrier plate and lane spacer includes utilizing a finishing layer of synthetic material.

5. A method as set forth in claim 1 wherein:

said steps of overlying said base surface includes utilizing an oil-impervious spacer and barrier plates.

6. A method as set forth in claim 1 wherein:

said step of overlying said approach section includes extending said approach barrier plate a predetermined distance rearwardly of said foul line less than the length of said approach section and overlying said base surface rearwardly of said approach section barrier plate with an approach section spacer of said predetermined thickness and overlying said approach section spacer with said finishing layer.

7. A method as set forth in claim 1 wherein:

said step of overlying said base surface includes selection of metal or plastic barrier plates and a compressed fiber lane spacer.

8. A method as set forth in claim 1 wherein:

said step of overlying said barrier plate with said finishing layer precedes said step of removing said existing finish, and includes pre-drilling fastener bores through said finishing layer and barrier plates.

9. A method as set forth in claim 1 wherein:
said step of overlying said base includes overlying said base section adjacent said approach section with a rigid oil-impervious plate.

10. A method for resurfacing a wooden bowling alley bed having an approach section, ball impact section, lane area and pin deck section, and comprising the steps of:
removing the existing finish on the alley bed by sanding its surface to a substantially even level to provide a base surface;
overlying said base surface with means of a uniform thickness, said means in at least one of said sections being in the form of a barrier plate of said uniform thickness, said barrier plate being characterized in that it has a harder top surface than said base surface and is sufficiently thick to be more resistant to downward flexing, or deformation of the top surface thereof by downwardly acting forces applied thereto than said base surface; and,
overlying said barrier plate with a preformed flexible finishing sheet.

11. The method defined in claim 10 that includes:
the step of securing said barrier plate to said base surface includes installation of mechanical anchors.

12. The method as defined in claim 10 wherein:
said step of overlying said base surface in said lane section includes utilizing a lane spacer constructed of a compressed fiber composition material which is relatively soft as compared to said barrier plate.

13. A resurfaced bowling alley having tongue and groove slats forming an elongated bed, such bed defining an approach section on one extremity thereof leading to a foul line, a pin deck section on the opposite extremity thereof for receiving bowling pins and an intermediate lane area, interposed between such approach and deck sections, said alley comprising:
a resurfaced even top surface on said tongue and groove bed;
a relatively rigid, pin deck barrier plate of a pre-determined thickness overlying said deck section for distributing downwardly acting forces over adjacent slats;
anchoring means anchoring said barrier plate to said bed;
a lane spacer of said predetermined thickness overlying said intermediate lane area to have the top surface thereof on the same level as the top surface of said barrier plate;
means of said uniform predetermined thickness overlying said approach section; and,
a relatively flexible preformed finishing layer overlying said means on said approach area, spacer and barrier plates whereby impact of said rebounded bowling pins on said finishing layer over said pin deck barrier plate will be resisted by said plate and will be distributed over a plurality of underlying and adjacent slats.

14. A bowling alley as set forth in claim 13 wherein:
said means overlying said approach section is constructed of a relatively rigid approach barrier plate.

15. A bowling alley as set forth in claim 13 wherein:
said approach barrier plate projects beyond said foul line for receiving and distributing forces of bowling balls lofted by bowler's delivering from said foul line.

16. A bowling alley as set forth in claim 13 that includes:
wood screws passing through said barrier plate and screwed into said slats to facilitate anchoring of said barrier plate to said bed.

17. A bowling alley as set forth in claim 11 that includes:
wood screws passing through said barrier plates and screwed into said slats for anchoring said barrier plate to said bed.

18. A bowling alley comprising:
an elongated bed defining an approach section at one extremity thereof and and leading forwardly in one direction to a foul line, a ball impact section beyond such foul line, an intermediate lane area leading forwardly of said ball impact section and a pin deck section formed at the extremity of said bed opposite said one section;
a barrier plate support surface formed on top of one of said sections;
a barrier plate on said barrier plate support surface, said barrier plate being formed with an upwardly facing top surface and being harder than said bed and being of a predetermined thickness sufficient to be more resistent to downward flexure and downward deformation of the top surface thereof by forces acting downwardly thereon then the top surface of said bed is resistant to downward flexure and deformation by downwardly acting forces;
affixing means affixing said barrier plate to said bed;
means affixed on said lane area and sections other than said one section forming an upwardly facing even finishing layer receiving top surface and being of sufficient thickness to place said finishing layer receiving top surface on the same level as said top surface of said barrier plate;
a synthetic flexible preformed finishing layer overlying said barrier plate and said means on said lane area and sections other than said one section; and,
adhesive means affixing said finishing layer to said means on said lane area, said sections other than said one section and said barrier plate whereby said finishing layer will provide the desired finished appearance for the top of said bowling alley and said barrier plate will resist downwardly acting forces applied to said finishing layer above said plate to thus support said layer against downward flexing and deformation to limit movement between said layer and base plate and the consequent developments of shear forces along the finishing layer and barrier plate interface.

19. A bowling alley as set forth in claim 18 wherein:
said bed is constructed of wood; and,
said barrier plate is constructed of metal or plastic.

20. A bowling alley as set forth in claim 19 wherein:
said barrier plate is substantially $\frac{3}{8}$ of an inch thick.

* * * * *